US009860650B2

(12) United States Patent
Bürger et al.

(10) Patent No.: US 9,860,650 B2
(45) Date of Patent: Jan. 2, 2018

(54) HEARING ASSISTANCE DEVICE COMPRISING A LOCATION IDENTIFICATION UNIT

(71) Applicant: Oticon A/S, Smørum (DK)

(72) Inventors: Christian C. Bürger, Holte (DK); Anja Ravn Madsen, Smørum (DK); Jesper Krogh Christensen, Smørum (DK); Mogens Cash Balsby, Smørum (DK); Morten Christophersen, Smørum (DK)

(73) Assignee: OTICON A/S, Smørum (DK)

( * ) Notice: Subject to any disclaimer, the term of this patent is extended or adjusted under 35 U.S.C. 154(b) by 12 days.

(21) Appl. No.: 14/834,087

(22) Filed: Aug. 24, 2015

(65) Prior Publication Data

US 2016/0057547 A1 Feb. 25, 2016

(30) Foreign Application Priority Data

Aug. 25, 2014 (EP) ..... 14182087

(51) Int. Cl.
*H04R 25/00* (2006.01)

(52) U.S. Cl.
CPC ..... *H04R 25/00* (2013.01); *H04R 25/552* (2013.01); *H04R 25/554* (2013.01); (Continued)

(58) Field of Classification Search
CPC .... H04R 25/00; H04R 25/552; H04R 25/558; H04R 2225/55; H04R 2225/61; H04R 25/40
See application file for complete search history.

(56) References Cited

U.S. PATENT DOCUMENTS 7,522,739 B2 * 4/2009 Rass ..... H04R 25/558 381/312
2002/0041695 A1 * 4/2002 Luo ..... H04R 3/005 381/313

(Continued)

FOREIGN PATENT DOCUMENTS

DE 10 2009 004 182 B3 4/2010
WO WO 2012/044278 A1 4/2012
WO WO 2012044278 A1 * 4/2012 ..... H04R 25/505

*Primary Examiner* — Md S Elahee
*Assistant Examiner* — Angelica M McKinney
(74) *Attorney, Agent, or Firm* — Birch, Stewart, Kolasch & Birch, LLP

(57) ABSTRACT

The application relates to a hearing assistance device adapted for being located in or at a specific one of a left or a right ear of a user, and comprising an input unit for receiving an input signal and an output unit for providing an output signal. The application further relates to a method and to a hearing assistance system. The application aims at providing an improved scheme for detecting left/right placement of a hearing device. The hearing assistance device further comprises a memory unit wherein information about the intended location of the hearing assistance device is or can be stored, a location identification unit configured to extract an intended location from said memory unit, and a user interface configured to convey information related to the intended and/or current location of the hearing assistance device. A user is thus informed, if the hearing assistance device(s) is/are not located as intended.

16 Claims, 7 Drawing Sheets

(52) U.S. Cl.
CPC ..... *H04R 25/558* (2013.01); *H04R 2225/55* (2013.01); *H04R 2225/61* (2013.01); *H04R 2460/07* (2013.01)

(56) References Cited

U.S. PATENT DOCUMENTS

| | | | | |
|---|---|---|---|---|
| 2004/0013280 | A1* | 1/2004 | Niederdrank | H04R 25/453 381/315 |
| 2007/0160242 | A1* | 7/2007 | Cadalli | H04R 25/552 381/312 |
| 2007/0223754 | A1* | 9/2007 | Roeck | H04R 25/552 381/313 |
| 2007/0269064 | A1* | 11/2007 | Allegro-Baumann | H04S 3/008 381/313 |
| 2008/0013762 | A1* | 1/2008 | Roeck | H04R 25/407 381/309 |
| 2008/0144867 | A1 | 6/2008 | Schulz | |
| 2010/0067707 | A1 | 3/2010 | Schwerdtner | |
| 2010/0310087 | A1* | 12/2010 | Ishida | H04R 1/1041 381/74 |
| 2013/0178162 | A1* | 7/2013 | Neumeyer | H04W 4/008 455/41.2 |
| 2014/0093088 | A1 | 4/2014 | Tachibana et al. | |
| 2015/0230036 | A1* | 8/2015 | Pedersen | H04R 1/1041 381/330 |

* cited by examiner

HEARING ASSISTANCE DEVICE COMPRISING A LOCATION IDENTIFICATION UNIT

TECHNICAL FIELD

The present application relates to hearing assistance devices. The disclosure relates specifically to a hearing assistance device adapted for being located in or at a left or right ear or a user, in particular to a hearing assistance device comprising a location identification unit configured to detect, whether the hearing assistance device is located at its intended position.

The application furthermore relates to a binaural hearing assistance system and to a method of operating a hearing assistance device.

Embodiments of the disclosure may e.g. be useful in applications such as hearing assistance devices, in particular binaural or bilateral hearing assistance systems comprising a left and a right hearing assistance device.

BACKGROUND

End users (or their caretakers) sometimes, by mistake, switch right and left devices of a binaural hearing assistance system between the ears. Users may e.g. confuse which device should be placed on the right ear and which aid should be placed on the left ear. This is especially true with behind-the-ear (BTE) styles. The interchange may e.g. happen when a BTE-user removes and cleans the ear molds (e.g. daily) and then reattaches the BTE-parts to them.

In case of hearing assistance devices adapted for compensating a hearing loss of a user, this may create problems, because hearing losses of left and right ears seldom are completely symmetric. Since such asymmetry is typically reflected in the fitting of binaural systems, it is important to ensure that each of the two (dedicated) hearing assistance devices (e.g. including BTEs) is placed on the respective correct ear. Misplacement will result in incorrect amplification ('bad fitting'). Depending on the differences in fitting, the mismatch may a) not be detected, b) clearly detected, or worse, c) detected as an irritation (without knowing its cause), which could lead to the perception that the hearing aids are of poor quality (and subsequent abandonment). Further, if a child receives incorrect amplification over a longer period of time due to a mismatch, this could lead to incorrect, delayed or difficult learning of speech.

Other problems related to location identification of hearing assistance devises may occur during a first time fitting. When making a first fitting of a new behind the ear instrument, the instrument itself does not know if it is put on the right and left ear. This is especially troublesome when using wireless communication between the 'left' and 'right' devices, since the fitting system then needs to acquire this information, e.g. through a special 'instrument selection window', which e.g. utilizes playback of tones in one of the instruments and detects the location of the active instrument. Since hearing losses are not prescribed in the hearing assistance devices at this time of the fitting process, an adjustment of the loudness of the tone may be necessary.

Today, a correct location of a hearing assistance device may be indicated by visually different labels or markers on the 'left' (e.g. indicated by a blue marker) and 'right' (e.g. indicated by a red marker) devices. For blind or visually impaired people and for people not knowing this color-code (e.g. substitutes in a nursery home or kindergarten teachers), such visual indication is insufficient to guarantee a correct placement. Also, for other users, the devices can be switched between ears by mistake.

WO2012044278A1 deals with a hearing instrument comprising means for actively identifying the hearing instrument as corresponding to a respective user's ear for which it was assigned.

US2008144867A1 deals with the correct assignment of the two hearing devices of a binaural hearing system to the ears or of the wearer during fitting.

Thus, there is a need for an improved (preferably automated) scheme for detecting whether a hearing assistance device is located as intended.

SUMMARY

An object of the present application is to provide an improved scheme for enabling a correct left/right placement of a hearing device. Preferably, the scheme should be automatic.

Objects of the application are achieved by the invention described in the accompanying claims and as described in the following.

A Hearing Assistance Device:

In an aspect of the present application, an object of the application is achieved by a hearing assistance device adapted for being fully or partially located in or at a specific one of a left or a right ear of a user, the hearing assistance device comprising an input unit for receiving an input signal and providing an electric input signal. Alternatively, the input unit may comprise a beamformer filter configured to focus the sensitivity of the input unit in a particular spatial direction, and the particular spatial direction may be a direction of a contra-lateral, hearing assistance device. Furthermore, the hearing assistance device comprising an output unit for providing an output signal a memory unit wherein information about the intended location of the hearing assistance device is or can be stored, a location identification unit configured to extract an intended location from said memory unit, and a user interface configured to convey information related to the intended and/or current location of the hearing assistance device.

This has the advantage that a user is informed if the hearing assistance devices are not located as intended.

In an embodiment, the location identification unit is configured to determine where the hearing assistance device is currently positioned. In an embodiment, the location identification unit is configured to determine whether the hearing assistance device is currently positioned at its intended location. The latter can e.g. be determined by comparing a current location with the (stored) intended location of the hearing assistance device in question.

In an embodiment, the location identification unit is configured to control the user interface, at least in a specific identification mode. In other words, the location is adapted to convey information about the intended and/or the current location of the hearing assistance device (incl. an information related thereto, e.g. a suggestion to alter the current location of one or both hearing assistance devices).

In an embodiment, the location identification unit is configured to convey information via the user interface, at least when it has been determined that the hearing assistance device is NOT positioned at its intended location. Alternatively or additionally, information may be displayed also in case that the hearing assistance device is correctly positioned.

In an embodiment, the hearing assistance device comprises a signal generator for generating an electric identification signal. Preferably, the location identification unit is configured to control the signal generator, which, in a specific identification mode of operation, is connected to the output unit and adapted to issue a first electric identification signal identifying the hearing assistance device. In an embodiment, the output unit is configured to transfer the electric identification signal to another device, e.g. to a remote control or to a contra-lateral hearing assistance device of a binaural or bilateral hearing assistance system.

The term 'mode of operation' is in the present context taken to mean a specific configuration (e.g. a low-power mode, where power consumption is minimized, e.g. by shutting down some functional parts of the device). The term may e.g. include a configuration comprising a specific set of processing parameters governing the processing of an input (audio) signal, e.g. a specific program adapted for a specific situation (e.g. a specific acoustic situation), where specific conditions prevail (e.g. speech in noise, or audio reception, etc.), or where a specific task is to be solved (e.g. location identification). The hearing assistance device may e.g. be configured to be brought in a particular mode of operation (e.g. the identification mode) by a predefined event (e.g. a startup procedure (power-up)) and/or by a user input (e.g. via the user interface) and/or by an automatic routine, e.g. based on a number of detectors or signal analysis.

In an embodiment, the location identification unit comprises an analysis unit, which in a specific identification mode of operation, is connected to the input unit, and wherein the analysis unit is configured to analyze an electric identification signal received from the input unit and to generate an identification control signal indicative thereof. In an embodiment, the input unit is configured to receive an electric identification signal from another device, e.g. from a contra-lateral hearing assistance device of a binaural or bilateral hearing assistance system.

In an embodiment, the location identification unit comprises an analysis unit, which in a specific identification mode of operation, is connected to the input unit, and wherein input unit receives an electric identification signal from the contra-lateral hearing assistance device, and wherein the analysis unit is configured to analyze the electric identification signal received from the input unit and to generate an identification control signal indicative thereof.

In an embodiment, the output unit comprises an output transducer for converting an electric output signal to an output sound, and wherein the input unit comprises an input transducer for converting an input sound to an electric input signal representative of the input sound. In an embodiment, the first electric identification signal is converted to a first identification sound by the output transducer.

In an embodiment, the output unit comprises a wireless transmitter for converting an electric output signal to a wireless signal, and wherein the input unit comprises a wireless receiver for receiving and converting a wireless signal to an electric input signal. In an embodiment, the hearing assistance device is configured to transmit the first electric identification signal via the wireless transmitter. In an embodiment, the hearing assistance device is configured to receive an electric identification signal from another device via the wireless receiver.

In an embodiment, the location identification unit is configured to control the signal generator to issue the first electric identification signal at a predetermined point in time. In an embodiment, the location identification unit is configured to control the signal generator to issue the first electric identification signal as a part of a startup procedure. In an embodiment, the first electric test signal is issued at a predetermined point in time relative to a change of mode or state (e.g. power-up) of the device, e.g. one minute after such change, e.g. after initiation of a power-up of the hearing assistance device. In an embodiment, the hearing assistance device is configured to allow a control of the location identification unit from the user interface. In an embodiment, the hearing assistance device is configured to allow a user to control a location identification procedure comprising issuance of the first electric identification signal via the user interface.

In an embodiment, the location identification unit is configured to control the user interface in dependence of the identification control signal. In an embodiment, the hearing assistance device comprises a memory wherein an identification code of one or more devices intended for being known by the hearing assistance device is/are or can be stored. In an embodiment, the hearing assistance device is configured to issue an alarm information via the user interface, in case the detected identification signal does not correspond to the expected device, or if no identification signal is detected (e.g. after a predefined time relative to an initiation of an identification procedure).

In an embodiment, the user interface comprises an output transducer, e.g. a loudspeaker (e.g. an output transducer of the output unit of the hearing assistance device). In an embodiment, the hearing assistance device is configured to issue the alarm information as a sound signal, e.g. a predetermined combination of beeps, or a spoken message (e.g. indicating the problem and a proposed solution). In an embodiment, the hearing assistance device is configured to provide that the alarm information is visually perceivable. In an embodiment, the user interface comprises a visual indicator, e.g. an LED or a display. In an embodiment, the user interface is implemented in a separate device, e.g. a remote control device, e.g. implemented as an APP of a SmartPhone or similar portable device, with which the hearing assistance device can exchange information (e.g. via a wireless link).

In an embodiment, the input unit comprises a beamformer filter configured to control the sensitivity of the input unit depending on a spatial direction relative to the input unit, and wherein the location identification unit, in the specific identification mode of operation, is configured to control the beamformer filter. In an embodiment, the location identification unit is configured to control the beamformer filter to focus the sensitivity of the input unit in a particular spatial direction.

In an embodiment, the hearing assistance device comprises a detector or sensor, e.g. for identifying a property or state, e.g. a movement, of the hearing assistance device and/or of the user wearing the hearing assistance device, e.g. a temperature (e.g. a body temperature). In an embodiment, the hearing assistance device comprises an accelerometer. When the head is being turned, the rotational movement of the accelerometer will detect a force that points away from the head of the user wearing the hearing assistance device. This force will thus point in the same direction as the location the hearing assistance device. In an embodiment, the hearing assistance device comprises a temperature sensor. Information from the accelerometer can e.g. by compared with information from other sensors, e.g. a temperature for sensing a temperature of the housing (or body, if in contact with the skin), or information extracted from processing algorithms, to make the conclusion more robust towards errors. Such information can e.g. be compared with similar information from another device (e.g. exchanged via a wireless link), e.g. a contra-lateral hearing assistance device of a binaural hearing assistance system.

In an embodiment, the hearing assistance device comprises two temperature sensors configured to sense a temperature of opposite outer surfaces of a housing of the hearing assistance device (e.g. of a BTE part for being located behind an ear (pinna) of a user). Preferably, a specific one of the opposing outer surfaces being adapted to face the skin of the user, when the hearing assistance device is mounted in the left side of the head of the user, and the other (the opposite) specific outer surface being adapted to face the skin of the user, when the hearing assistance device is mounted in the right side of the head of the user. Thereby it is possible by detection of the respective temperatures of the opposing outer surfaces of a given hearing assistance device to determine whether it is mounted on the left or right side of the head (and thus correctly located or not), and whether it is mounted on the body at all. It is thereby assumed that the surface of the housing facing the skin of the user has a higher temperature than the surroundings (including a higher temperature than the opposite surface).

In an embodiment, the hearing assistance device is adapted to provide a frequency dependent gain to compensate for a hearing loss of a user. In an embodiment, the hearing assistance device comprises a signal processing unit for enhancing the input signals and providing a processed output signal.

In an embodiment, the output unit is configured to provide a stimulus perceived by the user as an acoustic signal. In an embodiment, the output unit comprises a number of electrodes of a cochlear implant or a vibrator of a bone conducting hearing device. In an embodiment, the output unit comprises an output transducer comprising a receiver (speaker) for providing the stimulus as an acoustic signal to the user. In an embodiment, the output unit comprises a number of output transducers, e.g. a loudspeaker for acoustically stimulating the eardrum and a number of electrodes for electrically stimulating the cochlear nerve.

In an embodiment, the input unit comprises a directional microphone system adapted to enhance a target acoustic source among a multitude of acoustic sources in the local environment of the user wearing the hearing assistance device. In an embodiment, the directional system is adapted to detect (such as adaptively detect) from which direction a particular part of the microphone signal originates.

In an embodiment, the input unit comprises an antenna and transceiver circuitry for wirelessly receiving a direct electric input signal from another device, e.g. a communication device or another hearing assistance device. In an embodiment, the input unit comprises a (possibly standardized) electric interface (e.g. in the form of a connector) for receiving a wired direct electric input signal from another device, e.g. a communication device or another hearing assistance device. In general, the wireless link established by a transmitter and antenna and transceiver circuitry of the hearing assistance device can be of any type. In an embodiment, the wireless link is a link based on near-field communication, e.g. an inductive link based on an inductive coupling between antenna coils of transmitter and receiver parts. In another embodiment, the wireless link is based on far-field, electromagnetic radiation. In an embodiment, the hearing assistance device comprises antenna and transceiver circuitry for establishing a wireless link based on near-field communication to a contra-lateral hearing assistance device AND antenna and transceiver circuitry for establishing a wireless link based on far-field, electromagnetic radiation to an auxiliary device, e.g. a remote control device.

In an embodiment, the hearing assistance device, e.g. the microphone unit, and or the transceiver unit comprise(s) a TF-conversion unit (e.g. a filterbank) for providing a time-frequency representation of an input signal.

In an embodiment, the hearing assistance device comprises a (e.g. one or more) detector or sensor for identifying a property or state of the hearing assistance device, the environment (e.g. the physical and/or the acoustic environment) and/or the user and providing a control signal indicative of such property or state. The detector or sensor is preferably operationally connected to the location identification unit. In an embodiment, the location identification unit is configured to consider one or more control signals from the one or more detectors or sensors when determining whether the hearing assistance device is currently positioned at its intended location.

In an embodiment, the hearing assistance device comprises one or more detectors or sensors relating to a current physical environment of the hearing assistance device. Such environment detectors may e.g. comprise one or more of a proximity sensor, e.g. for detecting the proximity of an electromagnetic field (and possibly its field strength), the proximity of human skin, etc., a temperature sensor, a light sensor, a time indicator, a magnetic field sensor, a humidity sensor, a reverberation sensor, a movement sensor (e.g. an accelerometer or a gyroscope), etc.

In an embodiment, the hearing assistance device comprises one or more detectors or sensors relating to a current acoustic environment of the hearing assistance device.

Properties of the acoustic environment are typically reflected in signals of the forward path of the hearing assistance device (e.g. as picked up by an input transducer) or derivable there from and accounted for by detectors for analysing signals of the hearing assistance device. Such sensors may e.g. comprise one or more of a feedback path estimation unit, an autocorrelation detector, a cross-correlation detector, an overall signal level detector, a tone detector, a speech detector, etc. In an embodiment, the hearing assistance device is adapted to receive signals from external sensors of the acoustic environment, e.g. a separate microphone (e.g. located in a telephone or other device in (e.g. wireless) communication with the hearing assistance device).

In an embodiment, the hearing assistance device comprises one or more detectors or sensors relating to a current state of a wearer of the hearing assistance device. Such detectors may e.g. comprise one or more detectors configured to analyse properties of the user wearing the hearing assistance device to indicate a current state of the user, e.g. physical and/or mental state. In an embodiment, such detectors may include one or more of a motion sensor, a brainwave sensor, a sensor of cognitive load, a temperature sensor, a blood pressure sensor, an own voice detector, a temperature sensors, an accelerometer and/or a gyroscope.

In an embodiment, the hearing assistance device comprises one or more detectors or sensors configured to analyse or indicate signals relating to a current state or mode of operation of the hearing assistance device (including characteristics of signals of the hearing assistance device, e.g. feedback) and/or of another device in communication with the hearing assistance device (e.g. a contra-lateral device of a binaural hearing aid system). Examples of a state or mode of operation of the hearing assistance device are e.g. present choice of program, battery status, amount of feedback present, status of a wireless link, low power mode, normal mode, directional or omni-directional microphone mode, etc.

The above mentioned detectors or sensors are preferably adapted to provide corresponding control input signals to the location identification unit. Some of the detectors or sensors may—as the case may be—belong to more than one (or be included in either one of several) of the above defined four groups of signals or detectors.

In an embodiment, the hearing assistance device comprises an acoustic (and/or mechanical) feedback suppression system.

In an embodiment, the hearing assistance device further comprises other relevant functionality for the application in question, e.g. compression, noise reduction, etc.

In an embodiment, the hearing assistance device comprises a listening device, e.g. a hearing aid, e.g. a hearing instrument, e.g. a hearing instrument adapted for being located at the ear or fully or partially in the ear canal or fully or partially implanted in the heard of a user, or a headset, an earphone, an ear protection device or a combination thereof.

Use:

In an aspect, use of a hearing assistance device as described above, in the 'detailed description of embodiments' and in the claims, is moreover provided.

A Method:

In an aspect, A method of operating a hearing assistance device adapted for being fully or partially located in or at a specific one of a left or a right ear of a user, the hearing assistance device comprising an input unit for receiving an input signal and providing an electric input signal, and alternatively, the input unit may comprise a beamformer filter configured to focus the sensitivity of the input unit in a particular spatial direction, and the particular spatial direction is a direction of a contra-lateral, hearing assistance device. Furthermore, the hearing assistance device comprising an output unit for providing an output signal is furthermore provided by the present application. The method comprises a) storing the intended location of the hearing assistance device,
b) extracting an intended location of the hearing assistance device;
c) conveying information related to the intended and/or a current location of the hearing assistance device to a user interface.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

In an embodiment, the method comprises determining where the hearing assistance device is currently positioned. In an embodiment, the method comprises determining whether the hearing assistance device is currently positioned at its intended location, e.g. by comparing a current location with the (stored) intended location of the hearing assistance device in question.

In an embodiment, method comprises controlling the user interface in a specific identification mode, where information about the intended and/or the current location of the hearing assistance device (incl. an information related thereto, e.g. a suggestion to alter the current location of one or both hearing assistance devices) is conveyed to the user via the user interface.

Instead of being located at the ears of a user during a 'location identification procedure', a first and second hearing assistance device may be positioned side by side in a predetermined orientation relative to (and possibly distance from) each other on a table (possibly on an appropriate surface, e.g. in a specific box) in front of the user. An indication of a current non-intended positioning may then be used to switch the two devices before mounting them at the ears of the user.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application. In addition to being stored on a tangible medium such as diskettes, CD-ROM-, DVD-, or hard disk media, or any other machine readable medium, and used when read directly from such tangible media, the computer program can also be transmitted via a transmission medium such as a wired or wireless link or a network, e.g. the Internet, and loaded into a data processing system for being executed at a location different from that of the tangible medium.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Binaural Hearing Assistance System:

In a further aspect, a binaural hearing assistance system comprising first and second hearing assistance devices, each being a hearing assistance device as described above, in the 'detailed description of embodiments', and in the claims is moreover provided. The first hearing assistance device is adapted for being located in or at a left ear of a user, and the second hearing assistance device is adapted for being located in or at a right ear of a user.

In an embodiment, the respective signal generators of the first and second hearing assistance devices are configured, in a specific identification mode of operation, to issue first and second electric identification signals, respectively, which identify the first and second hearing assistance devices, respectively. In an embodiment, the first and second electric identification signals are configured to have characteristic properties that are recognizable in the analysis units of the respective first and second hearing assistance devices, considering the acoustic paths that the identification sound signals are expected to travel and/or considering the transfer functions of the output and input transducers.

In an embodiment, the analysis unit of the second hearing assistance device is configured to recognize the first identification sound by recognizing a first electric identification signal representative of the first identification sound (as received by the input transducer of the second hearing assistance device). In an embodiment, the analysis unit of the first hearing assistance device is configured to recognize a second identification sound (by recognizing a second electric identification signal representative of the second identification sound as received by the input transducer of the first hearing assistance device). In an embodiment, the first and second electric identification signals each comprise a specific combination of frequencies that are chosen with a view to allowing the identification signals to be distinguished from each other in the respective analysis units. In an embodiment, each of the analysis units of the first and second hearings assistance devices are configured to recognize each of the first and second electric identification signals.

In an embodiment, the location identification unit of the first hearing assistance device is configured to control the beamformer filter of the first hearing assistance device to provide that the particular spatial direction is a direction of the second, contra-lateral, hearing assistance device assuming that the first and second hearing devices are mounted at their intended locations.

In an embodiment, the location identification unit of the second hearing assistance device is configured to control the beamformer filter of the second hearing assistance device to provide that the particular spatial direction is a direction of the first, contra-lateral, hearing assistance device assuming that the first and second hearing devices are mounted at their intended locations. In an embodiment, the first and second hearing assistance device may be configured to identify themselves (e.g. as being a 'left' or 'right' device) in response to an identification request (from the user interface) by an acoustic or visual or haptic signal (e.g. via a user interface, e.g. an LED, or beeps or a spoken message, and/or via an auxiliary device, e.g. a remote control, e.g. via an APP, e.g. an APP of a communication device, e.g. a SmartPhone or a similar device.

In an embodiment, the binaural hearing assistance system further comprises an auxiliary device wherein at least a part of the user interface is implemented. In an embodiment, the hearing assistance system comprises an auxiliary device, e.g. a remote control, adapted for allowing an initiation of the identification procedure (from said part of the user interface), e.g. by (acoustically or electromagnetically) transmitting an identification request signal to one (or both) of the first and second hearing assistance devices. In an embodiment, the first and second hearing assistance device are configured to transmit a location identification signal in response to a received identification request signal. In an embodiment, the hearing assistance system is configured to provide that a resulting current location of the devices intended for being located at the left and right ear of the user is indicated via the part of the user interface implemented in the auxiliary device.

In an embodiment, the binaural hearing assistance system is adapted to combine information from one or more processing algorithms with information from one or more sensors. In an embodiment, the binaural hearing assistance system is adapted to combine information from each hearing assistance device derived from respective directional or spatial algorithms (e.g. source separation algorithms) combined with acceleration information from each hearing assistance device to determine which of the first and second hearing assistance devices that is currently positioned on the right side and which on the left side of the user's head. When movement of the head is detected from the acceleration information (provided by respective accelerometers), the physical angular or linear movement can be compared with the corresponding movement of the placement of sound sources (detected by the respective directional or spatial algorithms). The result of such comparison reveals whether the aid a given hearing assistance devices is positioned on the left or right side of the user's head.

In an embodiment, the system is adapted to establish a communication link between the hearing assistance device and the auxiliary device to provide that information (e.g. control and status signals, possibly audio signals) can be exchanged or forwarded from one to the other.

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing assistance device. In an embodiment, the auxiliary device is or comprises a remote control for controlling functionality and operation of the hearing assistance device (s). In an embodiment, the function of a remote control is implemented in a SmartPhone, the SmartPhone possibly running an APP allowing to control the functionality of the audio processing device via the SmartPhone (the hearing assistance device(s) comprising an appropriate wireless interface to the SmartPhone, e.g. based on Bluetooth or some other standardized or proprietary scheme).

In the present context, a SmartPhone, may comprise

- a (A) cellular telephone comprising a microphone, a speaker, and a (wireless) interface to the public switched telephone network (PSTN) COMBINED with
- a (B) personal computer comprising a processor, a memory, an operative system (OS), a user interface (e.g. a keyboard and display, e.g. integrated in a touch sensitive display) and a wireless data interface (including a Web-browser), allowing a user to download and execute application programs (APPs) implementing specific functional features (e.g. displaying information retrieved from the Internet, remotely controlling another device, combining information from various sensors of the smartphone (e.g. camera, scanner, GPS, microphone, etc.) and/or external sensors to provide special features, etc.).

Definitions:

In the present context, a 'hearing assistance device' refers to a device, such as e.g. a hearing instrument or an active ear-protection device or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing assistance device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing assistance device may be configured to be worn in any known way, e.g. as a unit arranged behind the ear with a tube leading radiated acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. The hearing assistance device may comprise a single unit or several units communicating electronically with each other.

More generally, a hearing assistance device comprises an input transducer for receiving an acoustic signal from a user's surroundings and providing a corresponding input audio signal and/or a receiver for electronically (i.e. wired or wirelessly) receiving an input audio signal, a signal processing circuit for processing the input audio signal and an output means for providing an audible signal to the user in dependence on the processed audio signal. In some hearing assistance devices, an amplifier may constitute the signal processing circuit. hi some hearing assistance devices, the output means may comprise an output transducer, such as e.g. a loudspeaker for providing an air-borne acoustic signal or a vibrator for providing a structure-borne or liquid-borne acoustic signal. In some hearing assistance devices, the output means may comprise one or more output electrodes for providing electric signals.

In some hearing assistance devices, the vibrator may be adapted to provide a structure-borne acoustic signal transcutaneously or percutaneously to the skull bone. In some hearing assistance devices, the vibrator may be implanted in the middle ear and/or in the inner ear. In some hearing assistance devices, the vibrator may be adapted to provide a structure-borne acoustic signal to a middle-ear bone and/or to the cochlea. hi some hearing assistance devices, the vibrator may be adapted to provide a liquid-borne acoustic signal to the cochlear liquid, e.g. through the oval window. In some hearing assistance devices, the output electrodes may be implanted in the cochlea or on the inside of the skull bone and may be adapted to provide the electric signals to the hair cells of the cochlea, to one or more hearing nerves, to the auditory cortex and/or to other parts of the cerebral cortex.

A 'hearing assistance system' refers to a system comprising one or two hearing assistance devices, and a 'binaural listening system' refers to a system comprising one or two hearing assistance devices and being adapted to cooperatively provide audible signals to both of the user's ears. Listening systems or binaural listening systems may further comprise 'auxiliary devices', which communicate with the hearing assistance devices and affect and/or benefit from the function of the hearing assistance devices. Auxiliary devices may be e.g. remote controls, audio gateway devices, mobile phones, public-address systems, car audio systems or music players. Hearing assistance devices, listening systems or binaural listening systems may e.g. be used for compensating for a hearing-impaired person's loss of hearing capability, augmenting or protecting a normal-hearing person's hearing capability and/or conveying electronic audio signals to a person.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference signs are used for identical or corresponding parts.

Figure 1A:
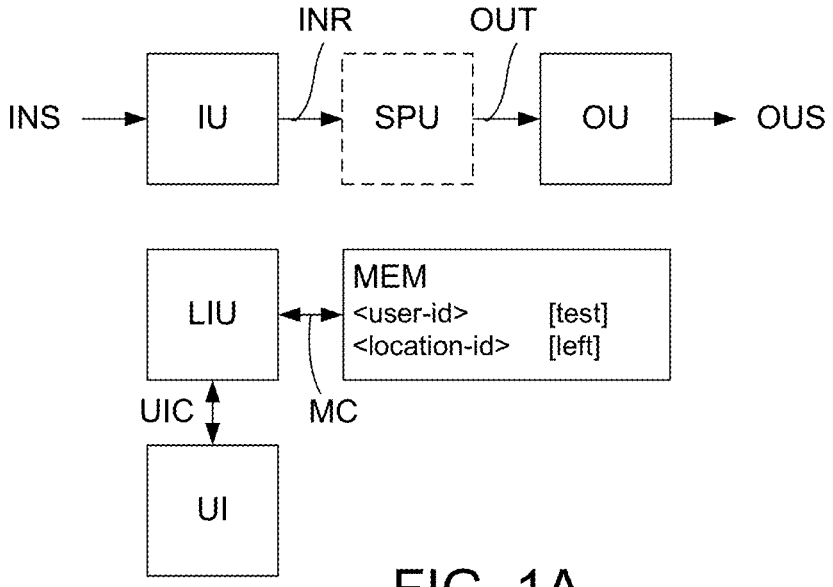
FIGS. 1A-1D show four exemplary embodiments of a hearing assistance device according to the present disclosure where an intended and/or a current location of the hearing assistance device is conveyed to a user or a caring person via a user interface, FIG. 1A illustrating an embodiment, where a stored intended location of the hearing assistance device is conveyed to a user via a user interface, FIG. 1B illustrating an embodiment, where a current location of the haring assistance device is detected by one or more detectors, FIG. 1C illustrating an embodiment, where a current location of the hearing assistance device is detected by detection of a location identification signal from a signal generator, and FIG. 1C illustrating an embodiment, where a current location of the hearing assistance device is detected using a beamformer filter, FIG. 1D illustrating an embodiment of a hearing assistance as in FIG. 1C, wherein the beamformer filter (BF) is configured to control the sensitivity of the input unit in dependence of a spatial direction relative to the input unit.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

Preferably, an identification of a specific hearing assistance device is predefined (and known to the device). In an embodiment, an intended location (e.g. at a left or right ear) of a specific hearing assistance device is stored in a memory (e.g. firmware, cf. e.g. parameter <location-id>in memory unit MEM in FIGS. 1A-1D) of the hearing assistance device in question (thereby allowing an intended location to be compared with a current location, if such current location is identified by the hearing assistance device or system). The information can be stored in any appropriate form (e.g. in the form of a code) that is accessible and intelligible to a signal processing unit of the hearing assistance device. Such information can e.g. be generated during a fitting of the hearing assistance system to a particular person. In addition to such embedded identification, an externally perceptible (e.g. visually perceptible) identification element (e.g. a color or text or a tactile marking) may be provided on each individual hearing assistance device of a hearing assistance system.

FIGS. 1A-1D show four exemplary embodiments of a hearing assistance device according to the present disclosure adapted for being located in or at a specific one of a left or a right ear of a user, the hearing assistance device comprising an input unit (IU) for receiving an input signal (INS) and providing an electric input signal (INR), and an output unit (OU) for providing an output signal (OUS). The hearing assistance device comprises a forward path from the input unit (IU) to the output unit (OU) preferably comprising a signal processing unit (SPU, dashed outline) for processing an electric input signal (INR) and providing a processed electric signal (OUT) to the output unit (OU). The forward path is configured to process a (received) sound signal (INS) and providing an output signal (OUS) representing an enhanced input signal (e.g. adapted to a user's needs, e.g. hearing impairment), the output signal being perceived by a user as sound. The hearing assistance device further comprises a memory unit (MEM) wherein information about the intended location <location-id> of the hearing assistance device is or can be stored, and a location identification unit (LIU) configured to extract an intended location from said memory unit (MEM), and a user interface (UI) configured to convey information related to the intended and/or current location of the hearing assistance device. The location identification unit (LIU) is operationally coupled to the memory unit (MEM) (cf. signal MC), and to the user interface (UI) (cf. signal UIC). An intended and/or a current location of the hearing assistance device is e.g. conveyed to a user or a caring person via the user interface (UI). The memory unit (MEM) may have other relevant data stored, e.g. as here, an identification of the particular user <user-id>of the hearing assistance device to whom it may be specifically adapted. In an embodiment, the user interface (UI) comprises an output transducer, e.g. a loudspeaker, and the alarm information is issued as a sound signal, e.g. a predetermined combination of beeps, or a spoken message (e.g. indicating the problem (e.g. 'devices are misplaced') and a proposed solution (e.g. 'swap devices')). Alternatively, the hearing assistance device may be configured to provide that the alarm information is visually perceivable via the user interface (UI), e.g. via visual indicator, e.g. an LED or a display. In an embodiment, the user interface (UI) is implemented in a separate device, e.g. a remote control device, e.g. implemented as an APP of a SmartPhone or similar portable device (cf. e.g. FIG. 5), with which the hearing assistance device can exchange information (e.g. via a wireless link). A location identification procedure may e.g. be automatically initiated, e.g. in connection with start-up of the hearing assistance device after a full or partial power-down. Alternatively or additionally, the location identification procedure may be initiated via the user interface (UI), e.g. by activation of an activation element, e.g. via button on the hearing assistance device or a touch screen of a remote control device.

FIG. 1A shows an embodiment of a hearing assistance device, where a stored intended location of the hearing assistance device is conveyed to a user via a user interface (UI), e.g. as a coded message (e.g. in the form of one or more 'beeps' or light from an LED, etc.).

Figure 1B:
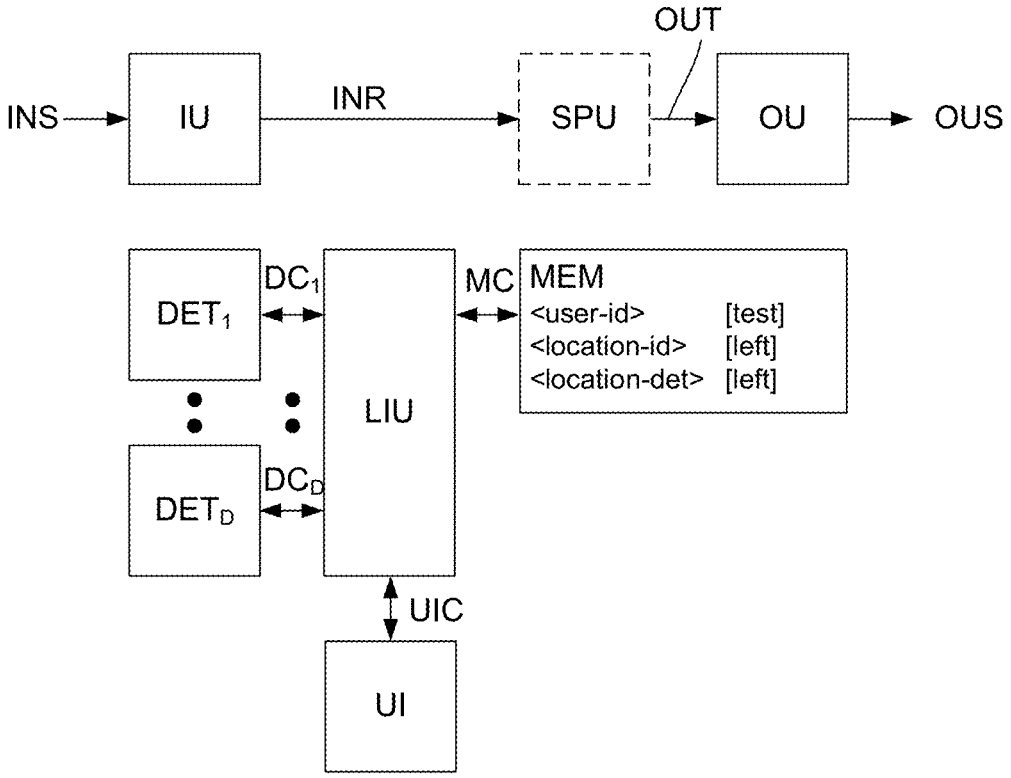

FIG. 1B shows an embodiment of a hearing assistance device comprising the same components that are shown in FIG. 1A. Alternatively or additionally, a current location of the hearing assistance device is detected by one or more detectors ($DET_1, \ldots, DET_D$), where D is the number of detectors operationally coupled to the location identification unit (LIU) (cf. signals $DC_1, \ldots, DC_D$). The one or more detectors may e.g. include a movement detector (e.g. an accelerometer or a gyroscope, or a combination thereof), a temperature sensor, etc. The detectors ($DET_1, \ldots, DET_D$) are used by the location identification unit (LIU) in the detection of a current location of the hearing assistance device, e.g. at a left or right ear of a user. A comparison between the intended (cf. <location-id>) and detected current location (<cf. location-det>) of the hearing assistance device is e.g. performed by the location identification unit (LIU), and a result (UIC) presented to the user via the user interface (UI).

Figure 1C:
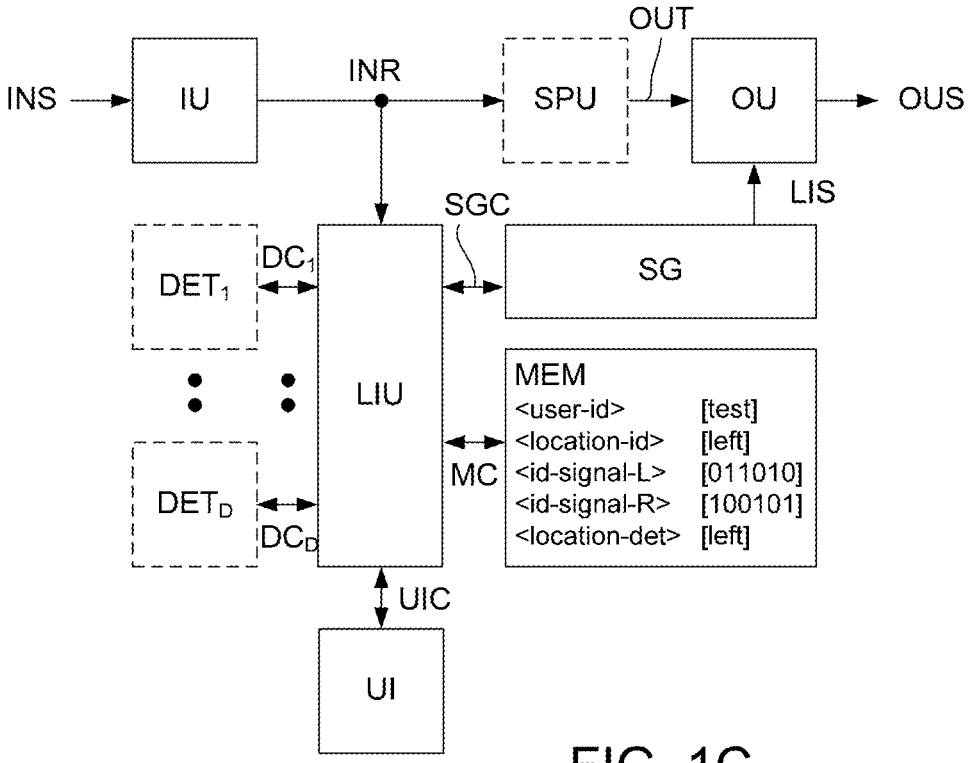

FIG. 1C illustrates an embodiment of a hearing assistance device comprising the same components that are shown in FIG. 1B. Alternatively or additionally, a current location of the hearing assistance device is detected (<cf. location-det>) by detection of a location identification signal (LIS) from a signal generator (SG). The signal generator (SG) is configured to generate an electric identification signal (LIS). The location identification unit (LIU) is configured to control the signal generator (SG) (cf. signal SGC), which, in a specific identification mode of operation, is connected to the output unit (OU) and adapted to issue a first electric identification signal (LIS) identifying the hearing assistance device. In the embodiment of FIG. 1C, it is assumed that exemplified hearing assistance device is intended for being located at the left ear and correctly positioned there. It is further assumed that a contra-lateral hearing assistance device (intended for being located and correctly positioned at the right ear) has issued a location identification signal (LIS) (<id-signal-R>= [100101]) and that this signal has been correctly identified by the location identification unit (LIU) of the left hearing assistance device (in the received signal (INR) via input unit (IU)). The location identification unit (LIU) of the left hearing assistance device then concludes that it is correctly mounted and is configured to present this information to the user via the user interface (UI).

In an embodiment, the location identification signal (LIS) is a noise signal (e.g. a masked noise signal) and the location identification procedure comprises:

1. Using the sound generators (SG) in one of the left and right hearing assistance devices, a special designed noise signal is sent from one hearing aid (e.g. the left).
2. Using the sound detection system in the hearing assistance device, the noise signal is detected (e.g. in the right).

3. The hearing assistance device (e.g. the right) (e.g. the location identification unit (LIU)) analyzes, if the noise signal is detected from the expected sound/device (i.e. from the left device =<id-signal-L>=[011010]).
4. If this is not the case, the hearing assistance device will either: a) play a sound using the tone generator or b) issue a blinking pattern using the LED, or c) otherwise communicate the information to the user via the user interface (UI).

Figure 1D:
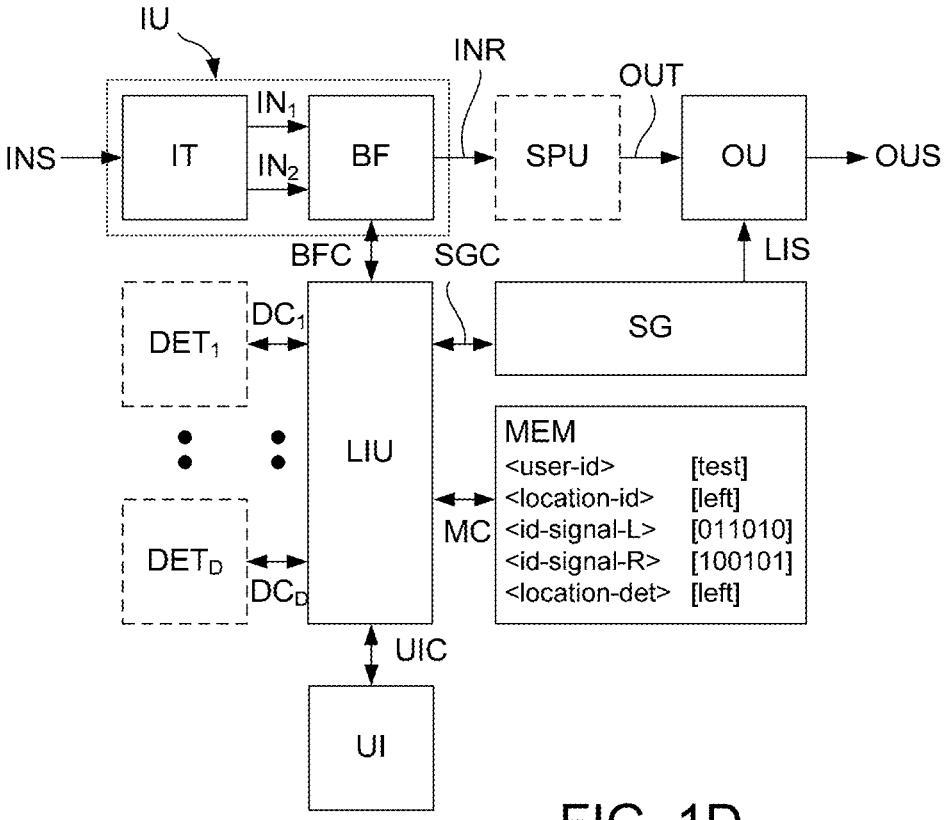

FIG. 1D illustrates an embodiment of a hearing assistance device comprising the same components that are shown in FIG. 1C, but where a current location of the hearing assistance device is detected using a beamformer filter (BF) configured to control the sensitivity of the input unit in dependence of a spatial direction relative to the input unit (e.g. depending on the direction from the input unit to a sound source in its environment). The input unit (IU) comprises one or more (e.g. 2) input transducers unit IT), e.g. one or more microphones, providing input signals $IN_1$, $IN_2$. In an embodiment, the location identification unit (LIU), in a specific identification mode of operation, is configured to control the beamformer filter (BF) (cf. signal BFC). In an embodiment, the location identification unit (LIU) is configured to control the beamformer filter (BF) to focus the sensitivity of the input unit (IU) in a particular spatial direction. In an embodiment comprising first and second hearing assistance devices of a binaural hearing assistance system (cf. also FIGS. 2A-2B), the location identification unit (LIU) of the second hearing assistance device is configured to control the beamformer filter (BF) of the second hearing assistance device to provide that the particular spatial direction is a direction of the first, contra-lateral, hearing assistance device, assuming that the first and second hearing devices are mounted at their intended locations. In the identification mode of operation, where an identification signal (LIS) is issued by at least one of the first and second hearing assistance devices, the identification signal will be received by the contra-lateral hearing assistance device, if the two hearing assistance devices are mounted as intended (because the beamformer 'looks' in the direction of the contra-lateral hearing assistance device). If, on the other hand, the two hearing assistance devices are switched (i.e. located at an opposite position compared to the intended one), the identification signal will not be received by the (contra-lateral) hearing assistance device (or received with a much lower level compared to a situation, where the devices are correctly mounted (because the beamformer 'looks' in the opposite direction of the hearing assistance device issuing the identification signal)). In an embodiment, the first and second hearing assistance devices are configured to issue different identification signals ($LIS_1$, $LIS_2$), possibly at different points in time (e.g.

relative to a power-on time). This will improve the reliability of the detection of the current location of the hearing assistance device. In case it is detected that the hearing assistance devices are not located at their intended positions, the location identification unit (LIU) of at least one (such as both) of the devices is preferably configured to issue an information signal to this topic via the user interface (UI).

Alternatively, the hearing assistance system may be configured to provide that only one of the devices (e.g. the one that is intended to be mounted at a left ear) issue an identification signal. This provides a simple system.

Figure 2A:
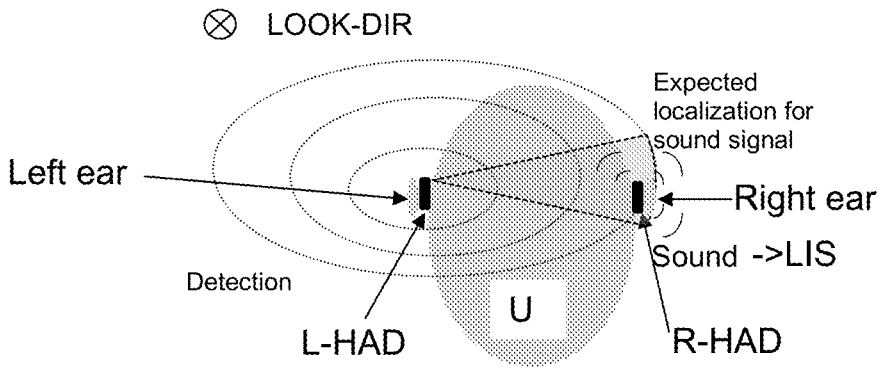
FIGS. 2A-2B show an embodiment of a hearing assistance system according to the present disclosure where a current location of the hearing assistance devices of the system is detected using a beamformer filter, FIG. 2A and FIG. 2B illustrating situations where the hearing assistance devices of the system are positioned as intended and opposite intended, respectively.
Figure 2B:
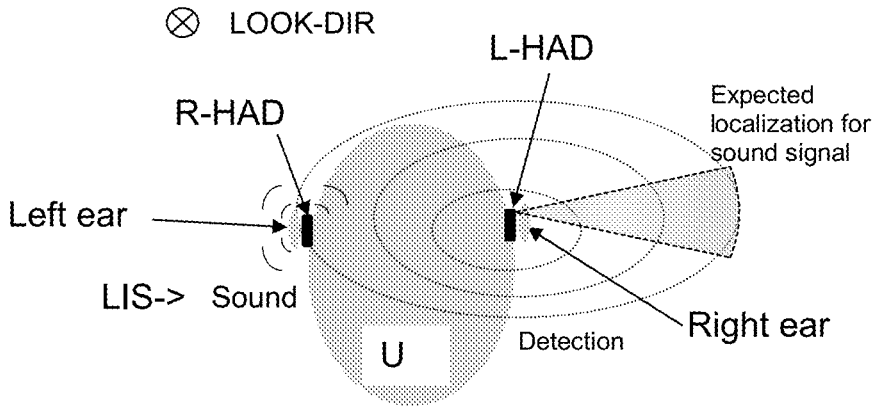

FIGS. 2A-2B show an embodiment of a hearing assistance system according to the present disclosure where a current location of the hearing assistance devices of the system is detected using a beamformer filter (cf. e.g. FIG. 1D). FIG. 2A and FIG. 2B illustrates situations where the left (L-HAD) and right (R-HAD) hearing assistance devices of the system are positioned as intended and opposite intended, respectively. The left (L-HAD) and right (R-HAD) hearing assistance devices are intended to be positioned at the left (Left ear) and right ears (Right ear) of a user (U, and information to this effect is stored in the respective devices, e.g. in MEM-unit of FIG. 1). In the example of FIG. 2, the user is assumed to look in a direction (LOOK-DIR) perpendicular to the cross-sectional view of the user's head (into the plane, as indicated by the symbol next to LOOK-DIR).

As part of an automatic "startup-procedure" (or on request of a user), the system enters a location identification procedure, wherein (at least) one of the hearing assistance devices (e.g. the right, R-HAD) sends out a location identification sound signal (sound, LIS) (e.g. a special noise signal or other recognizable signal) at a given time after being turned on (e.g. one minute after). At least one (e.g. both) of the hearing assistance devices (e.g. the left) enters a specific directional mode, where the beamformer filter is directed towards the expected position of the opposite hearing assistance device (e.g. by activating a predefined look-vector of the beamformer). The location identification sound signal (sound, LIS) will then be detected (Detection) by the contra-lateral hearing assistance device, if properly positioned (cf. Expected localization of sound signal in FIGS. 2A-2B) at the (correct) opposite ear (e.g. left), cf. FIG. 2A. The detected signal will then be compared to what was expected in the location identification unit (LIU) (as e.g. stored in the memory unit (MEM), i.e. did the received signal come from the correct position? And/or did the signal have the correct characteristics/ID) and an appropriate conclusion is drawn.

If the detected current position of the hearing assistance devices is not as expected (not correct), cf. FIG. 2B, the hearing assistance system should send out a warning via the user interface (UI) (e.g. for adults: 'beeps or a voice telling the hearing aids are switched' and e.g. for pediatric fittings: 'a blinking pattern' in the LED).

It is proposed to use information derived from the directional algorithms or special resolution algorithms in combination with a detector, e.g. combined with acceleration information from an acceleration detector (e.g. $DET_i$ in FIG. 1) to determine which device is located on the right and left sides of the head (cf. also FIG. 3A), to make the decision more robust.

This solution can e.g. be applied to:

Individual directional hearing assistance devices.

A pair of data linked single-microphone hearing assistance devices.

A pair of data linked directional hearing assistance devices.

In a specific embodiment, the detecting of the current location of the hearing assistance devices may be achieved in that the devices use their directionality or spatial information algorithms to identify significant external sound sources. Further, the angular placement of these sources may be tracked and compared with angular information derived from the build in accelerometers. Alternatively, the accelerometers may have their output combined to detect rotational acceleration.

When movement of the head is detected by use of accelerometers, the physical angular or linear movement can be compared with the corresponding movement of the placement of sound sources (detected by the directional or spatial algorithms). The result of this comparison will tell if a device is on the left or right side of the head.

In a case where the hearing assistance system comprises two omni directional hearing assistance devices (each comprising a single input transducer), the devices must be data linked to form a two microphone directional 'side fire' system.

Figure 3A:
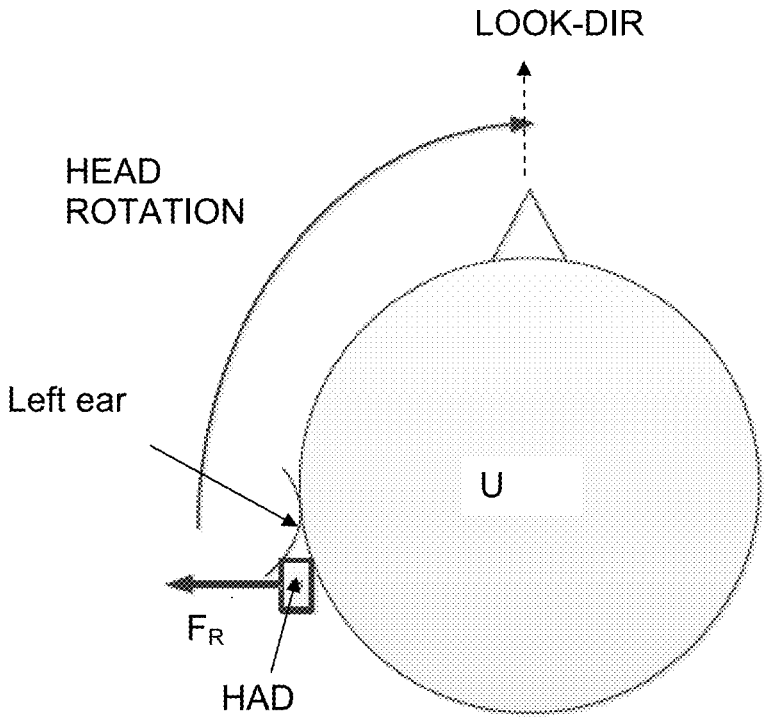
FIGS. 3A-3B show two exemplary embodiments of a hearing assistance device/system according to the present disclosure comprising one or more detectors for determining a current location of the hearing assistance device, FIG. 3A illustrating a hearing assistance device wherein the one or more detectors comprise(s) an acceleration sensor, and FIG. 3B illustrating a binaural hearing assistance system wherein the one or more detectors of each of the left and right hearing assistance devices comprise comprise(s) two temperature sensors.
Figure 3B:
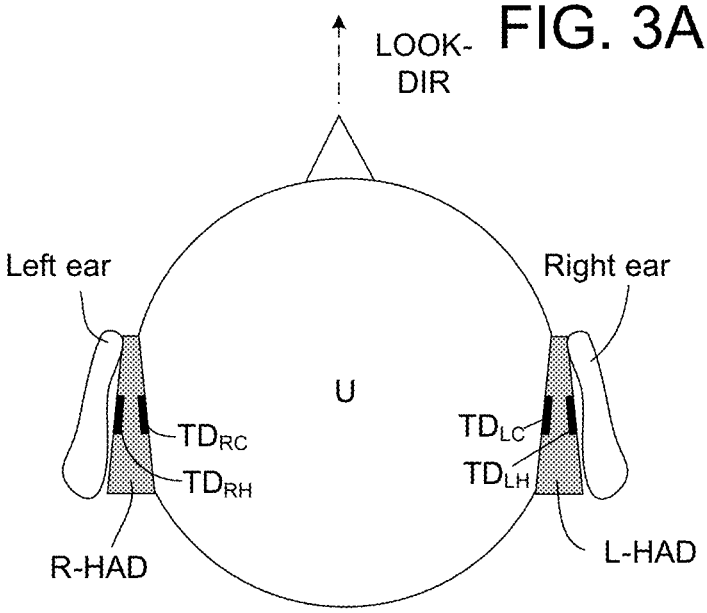

FIGS. 3A-3B show two exemplary embodiments of a hearing assistance device/system according to the present disclosure comprising one or more detectors for determining a current location of the hearing assistance device.

FIG. 3A illustrates a hearing assistance device (HAD) wherein the one or more detectors comprise(s) an acceleration sensor. FIG. 3A shows a setup, where a user (U) has a hearing assistance device (HAD) mounted on the left ear (Left ear). A look direction of the user is indicated by dashed arrow denoted (LOOK-DIR). Through the use of an accelerometer in the hearing assistance device (HAD), it is be possible to detect, if the device is on the right or left side simply by the head movement. When the head is being turned, the rotational movement (HEAD ROTATION) will put effect the accelerometer with a force ($F_R$) that will point away from the head of the end user (U). This force will thus point in the same direction, where the device is positioned. In other embodiments, the use of an acceleration sensor is used in combination with other sensors or detection methods to enhance the risk of drawing false conclusions regarding the current placement of the devices. In an embodiment, data from acceleration sensors for the left and right hearing assistance devices are compared to further improve robustness.

FIG. 3B illustrates a binaural hearing assistance system wherein the one or more detectors of each of the left (L-HAD) and right (R-HAD) hearing assistance devices comprise(s) two temperature sensors ($TD_{RC}$, $TD_{RH}$) and ($TD_{LC}$, $TD_{LH}$), respectively. The embodiment of FIG. 3B illustrates a scenario where location information (whether a given device is located on a left or right ear) can be automatically derived using body heat detection (by measuring a temperature of the body where (a BTE-part of) the hearing assistance device touches the skin of the head).

Temperature sensors (($TD_{LC}$, $TD_{LH}$) and ($TD_{RC}$, $TD_{RH}$)), in the left and right side of the left and right hearing assistance devices ((L-HAD) and (R-HAD) are used to detect the heat from the head, and thereby determine whether the device in question is located at the left or right ear. A temperature sensor with subscript C (cold) ($TD_{LC}$ and $TD_{LC}$) in the left and right hearing assistance devices, respectively) is expected to face away from the skin of the user, and thus to have a relatively lower temperature (assuming that the surrounding temperature is lower than the body temperature). Similarly, a temperature sensor with subscript H (hot) ($TD_{LH}$ and $TD_{LH}$) in the left and right hearing assistance devices, respectively) is expected to face towards the skin of the user, and thus to have a relatively higher temperature (assuming that the surrounding temperature is lower than the body temperature).

Usually the hearing assistance device is configured to be customized either for a left ear (Left ear) or a right ear (Right ear), so this feature can be used to inform the user of faulty wearing of the hearing assistance devices.

Two scenarios can be addressed with this embodiment:

a) If the user mounts his (pre-configured) left and right hearing assistance devices wrongly, the system will detect this and inform the user.
b) If the first and second hearing assistance devices are not preconfigured (to a left and right ear), this can be done automatically (e.g. in a first time fitting situation, where the devices are to be adapted to different conditions (e.g. hearing impairment) of the left and right ear) because the devices are able to auto-detect their respective positions.

Figure 4:
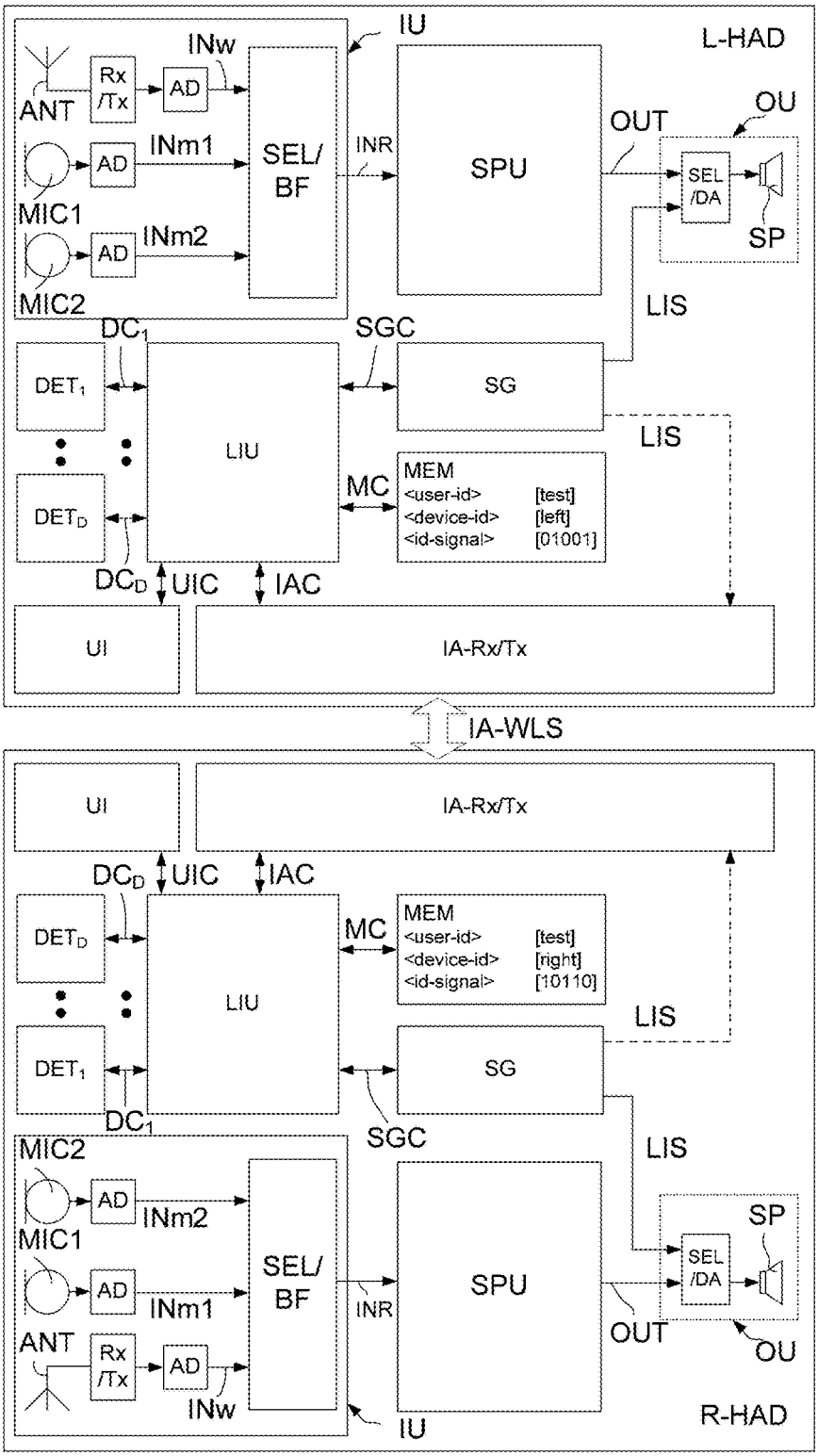
FIG. 4 shows an embodiment of a binaural hearing assistance system comprising first and second hearing assistance devices according to the present disclosure.

FIG. 4 shows an embodiment of a binaural hearing assistance system comprising first and second hearing assistance devices according to the present disclosure.

The binaural hearing assistance system comprises first (L-HAD) and second (R-HAD) hearing assistance devices (configured to be positioned at the left and right ears of the user, respectively) adapted for being located at or in left and right ears of a user, respectively. The hearing assistance devices are adapted for exchanging information between them via a wireless communication link, e.g. a specific inter-aural (IA) wireless link (IA-WLS). The two hearing assistance devices (L-HAD, R-HAD) are adapted to allow the exchange of status signals, e.g. including location identification information, information from one or more detectors (cf. e.g. FIGS. 3A-3B), and/or the transmission of characteristics of the input signal (e.g. extracted from or by using an algorithm or detector, cf. e.g. FIGS. 2A-2B) received by a device at a particular ear to the device at the other ear. To establish the inter-aural link, each hearing assistance device comprises antenna and transceiver circuitry (here indicated by block IA-Rx/Tx). Each hearing assistance device L-HAD and R-HAD is an embodiment of a hearing assistance device as described in the present application, e.g. in connection with FIGS. 1A-1D. In the binaural hearing aid system of FIG. 4, signals related to current (and/or intended) location identification generated in one of the hearing assistance devices (e.g. L-HAD) is transmitted to the other hearing assistance device (e.g. R-HAD) and/or vice versa. The signals from the local and the opposite device are e.g. used together to influence a decision regarding the current location of the hearing assistance device in question. The control signals may e.g. comprise directional information or information relating to a classification of the current acoustic environment of the user wearing the hearing assistance device, to the condition of the user, etc. Referring to FIG. 4, such signals may e.g. include identification signal LIS from signal generator SG (cf. dashed arrow between units SG and IA-Rx/Tx) and IAC from the location identification unit LIU, e.g. comprising current or intended localization data and/or data from detectors (cf. e.g. FIG. 3B), etc. In an embodiment, respective parts of the antenna and transceiver circuitry (IA-Rx/Tx) of the interaural link form part of the input (IU) and output (OU) units, respectively (e.g. in a specific identification mode of operation where the location identification signal LIS is transmitted from one device to the other via the interaural link IA-WLS).

In an embodiment, the binaural hearing assistance system further comprises a remote control device, a cellular telephone, or an audio gateway device for receiving a number of audio signals and for transmitting at least one of the received audio signals to the hearing assistance devices.

The input unit (IU) of the left (L-HAD) and right (R-HAD) hearing assistance devices comprises two input transducers, here two microphones ($MIC_1$), ($MIC_2$) and antenna and wireless transceiver circuitry (ANT, Rx/Tx) for establishing a wireless link to an auxiliary device, e.g. a remote control device, a cellular telephone, or an audio gateway device. In an embodiment, the antenna and wireless transceiver circuitry (ANT, Rx/Tx) is adapted to establish an analogue (e.g. FM) or a digital link, e.g. according to a communication standard, e.g. Bluetooth (such as Bluetooth Low Energy) to another device. The input unit further comprises analogue to digital converters (AD) as necessary to convert an analogue input signal to a digital signal. The input unit (IU) further comprises a selector unit and a beamformer filter (combined in SEL/BF-unit in FIG. 4). The selector unit may select the resulting inputs to the beamformer filter and/or the resulting input signal INR (output of SEL/BF-unit). The resulting input signal (INR) may be one of the microphone signals $INm_1$, $INm_2$) or the wirelessly received signal (INw) or a combination thereof, e.g. a beamformed signal resulting from a weighted combination of two or more of the input signals ($INm_1$, $INm_2$, INw). The selector-beamformer unit (SEL/BF) may be controlled via the user interface (IU) and/or automatically determined according to the current mode of operation of the hearing assistance system. The output unit (OU) comprises a selector unit (SEL) and a digital to analogue converter unit (DA) (if considered appropriate), here integrated in the same unit (SEL/DA). The output of the SEL/DA-unit is connected to the output transducer, here loudspeaker SP for generating an acoustic sound based on electric output OUT (representing a sound signal) or location identification signal LIS. The location identification signal LIS (applied in a particular location identification mode of operation, cf. e.g. FIGS. 2A-2B) is generated by the signal generator (SG) controlled by the location identification unit (LIU). The selector may e.g. be controlled by the location identification unit (LIU) and/or via the user interface (UI).

Figure 5:
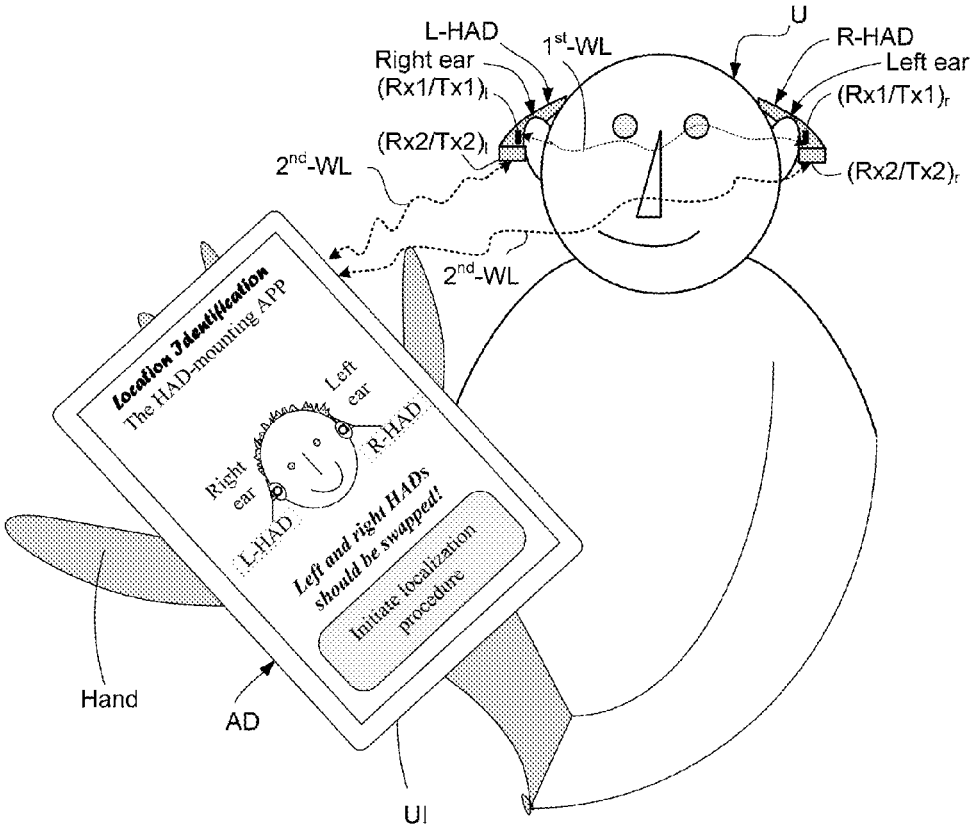
FIG. 5 shows an embodiment of a binaural hearing aid system comprising first and second hearing assistance devices in communication with an auxiliary device functioning as a user interface for the binaural hearing aid system.

FIG. 5 shows an embodiment of a binaural hearing aid system comprising first and second hearing assistance devices in communication with an auxiliary device functioning as a user interface for the binaural hearing aid system.

FIG. 5 shows an embodiment of a binaural hearing aid system comprising left (L-HAD, second) and right (R-HAD, first) hearing assistance devices in communication with a portable (handheld) auxiliary device (AD) functioning as a user interface (UI) for the binaural hearing aid system. In an embodiment, the binaural hearing aid system comprises the auxiliary device (and the user interface) and is configured to display the link quality measures estimated by the system. The user interface displaying the current and/or intended location of the first and second hearing assistance devices of the binaural hearing aid system may be implemented as an APP of the auxiliary device (e.g. a SmartPhone). In the embodiment of FIG. 5, the available wireless links are denoted $1^{st}$-WL (e.g. an inductive link between the hearing assistance devices) and $2^{nd}$-WL (e.g. RF-links (e.g. based on Bluetooth or the like) between the auxiliary device AD and the left (L-HAD) and the right (R-HAD) hearing assistance devices). The $1^{st}$ and $2^{nd}$ wireless interfaces are implemented in the left and right hearing assistance devices (L-HAD, R-HAD) by antenna and transceiver circuitry Rx1/Tx1 and Rx2/Tx2, respectively. The auxiliary device AD comprising the user interface (UI) is adapted for being held in a hand (Hand) of a user (U), and hence convenient for displaying a current arrangement of the hearing assistance devices. The APP Location Identification (The HAD-mounting APP) illustrates a user's head and the current position of the hearing assistance devices of the system and thus reflects whether the devices are at their intended location (as received from the hearing assistance devices via the $2^{nd}$ wireless interface ($2^{nd}$-WL). In the illustrated example case, the devices are not located correctly and this information is (in addition to the graphical display) conveyed to the user as the text message 'Left and right HADs should be swapped!' appearing on the display screen of the user interface (UI) of the auxiliary device (AD). Further, a localization procedure can be initiated via the user interface (UI) by activating the element 'Initiate localization procedure' on the display screen (bottom part of the screen in the above example). If the problem has been solved in the meantime (devices swapped between the ears), the user interface will reflect that in an updated display of the current situation, indicated graphically and by the text message 'Left and right HADs are located as intended!'.

Figure 6:
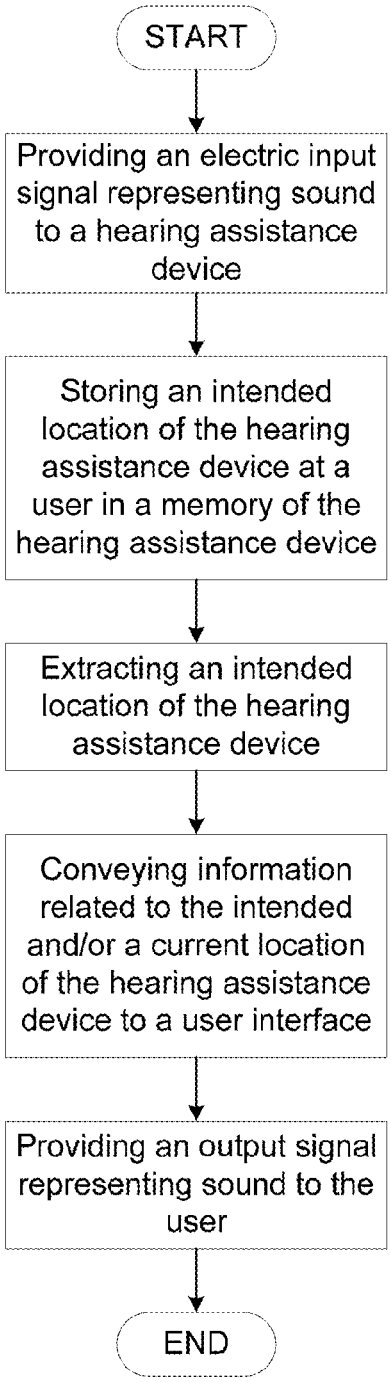
FIG. 6 shows a flow diagram of an embodiment of a method of operating a hearing assistance according to the present disclosure.

FIG. 6 shows a flow diagram of an embodiment of a method of operating a hearing assistance according to the present disclosure. In an embodiment, the method of operating a hearing assistance device adapted for being located in or at a specific one of a left or a right ear of a user, wherein the hearing assistance device comprises an input unit for receiving an input signal, and an output unit for providing an output signal, comprises the following steps

- Providing an electric input signal representing sound to a hearing assistance device;
- Storing an intended location of the hearing assistance device at a user in a memory of the hearing assistance device;
- Extracting an intended location of the hearing assistance device;
- Conveying information related to the intended and/or a current location of the hearing assistance device to a user interface; and
- Providing an output signal representing sound to the user.

The hearing assistance device may e.g. incorporate a hearing assistance device configured to apply a frequency dependent gain to an input signal to compensate for a hearing loss of the user, and to provide an enhanced output signal to be perceived by the user as sound. The sensation of the enhanced output signal as sound may e.g. be conveyed to the user by a loudspeaker for generating acoustic waves in air in the user's ear canal, or by a vibrator for mechanically exciting a skull bone of the user, or by implanted electrodes for electrically stimulating a cochlear nerve of the user (or combinations thereof).

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims and equivalents thereof.

REFERENCES

WO2012044278A1 (SIEMENS HEARING INSTR INC) 05 Apr. 2012

US2008144867A1 (SIEMENS AUDIOLOGISCHE TECHNIK) 19 Jun. 2008

The invention claimed is:

1. A hearing assistance device adapted for being fully or partially located in or at a specific one of a left or a right ear of a user, the hearing assistance device comprising:

an input unit for receiving an input signal and providing an electric input signal, wherein the input unit comprises a beamformer filter configured to focus the sensitivity of the input unit in a particular spatial direction, and the particular spatial direction is a direction of a contra-lateral, hearing assistance device;

an output unit for providing an output signal;

a memory unit configured to store information about an intended location of the hearing assistance device, wherein the intended location is the left ear or the right ear of the user;

a location identification unit configured to extract the intended location from said memory unit and to determine a current location of the hearing assistance device based on an output of the beamformer filter, wherein the current location is the left ear or the right ear of the user; and a user interface configured to convey information, to the user, related to the intended and/or current location of the hearing assistance device.

2. A hearing assistance device according to claim 1 wherein the location identification unit is configured to determine whether the hearing assistance device is currently positioned at its intended location.

3. A hearing assistance device according to claim 1 comprising a signal generator for generating an electric identification signal, the location identification unit being configured to control the signal generator which, in a specific identification mode of operation, is connected to the output unit and adapted to issue a first electric identification signal identifying the hearing assistance device.

4. A hearing assistance device according to claim 1, wherein the location identification unit, in a specific identification mode of operation, is connected to the input unit, and wherein input unit receives an electric identification signal from the contra-lateral hearing assistance device, and wherein the location identification unit is configured to analyze the electric identification signal received from the input unit and to generate an identification control signal indicative thereof.

5. A hearing assistance device according to claim 1, wherein the output unit comprises an output transducer for converting an electric output signal to an output sound, and wherein the input unit comprises an input transducer for converting an input sound to an electric input signal representative of the input sound.

6. A hearing assistance device according to claim 1, wherein the output unit converts an electric output signal to a wireless output signal, and wherein the input unit receives a wireless input signal and converts the wireless input signal to an electric input signal.

7. A hearing assistance device according to claim 1, wherein the hearing assistance device is configured to enter said specific identification mode of operation as a part of a startup procedure.

8. A hearing assistance device according to claim 1, wherein the location identification unit is configured to control the user interface in dependence of the identification control signal.

9. A hearing assistance device according to claim 1, wherein the location identification unit, in the specific identification mode of operation, is configured to control the beamformer filter.

10. A hearing assistance device according to claim 1 comprising a detector or sensor for identifying a property or state of the hearing assistance device and/or of the user and/or of the environment of the hearing assistance device.

11. A hearing assistance device according to claim 1 comprising two temperature sensors configured to sense a temperature of opposite outer surfaces of the housing of the hearing assistance device.

12. A binaural hearing assistance system comprising first and second hearing assistance devices, each being a hearing assistance device according to claim 1, and wherein the first hearing assistance device is adapted for being fully or partially located in or at a left ear of a user, and wherein the second hearing assistance device is adapted for being fully or partially located in or at a right ear of a user.

13. A binaural hearing assistance system according to claim 12, wherein the location identification unit of the first hearing assistance device is configured to control the beamformer filter of the first hearing assistance device to provide that the particular spatial direction is a direction of the second, contra-lateral, hearing assistance device when the first and second hearing devices are mounted at their intended locations.

14. A binaural hearing assistance system according to claim 12 further comprising an auxiliary device wherein at least a part of the user interface is implemented.

15. A binaural hearing assistance system according to claim 13 farther comprising an auxiliary device wherein at least a part of the user interface is implemented.

16. A method of operating a hearing assistance device adapted for being fully or partially located in or at a specific one of a left or a right ear of a user, the hearing assistance device comprising an input unit for receiving an input signal and providing an electric input signal, wherein the input unit comprises a beamformer filter configured to focus the sensitivity of the input unit in a particular spatial direction, and the particular spatial direction is a direction of a contra-lateral, hearing assistance device, and an output unit for providing an output signal, the method comprising:

a) storing an intended location of the hearing assistance device, wherein the intended location is the left ear or the right ear of the user;

b) extracting an intended location of the hearing assistance device;

c) determining a current location of the hearing assistance device based on an output of the beamformer filter, wherein the current location is the left ear or the right ear of the user; and d) conveying information related to the intended and/or a current location of the hearing assistance device to a user interface.

* * * * *